United States Patent [19]

Haun et al.

[11] Patent Number: 4,960,503

[45] Date of Patent: Oct. 2, 1990

[54] HEATING FCC FEED IN A BACKMIX COOLER

[75] Inventors: Edward C. Haun, Gendale Heights; Steven S. Milner; David A. Lomas, both of Arlington Heights, all of Ill.

[73] Assignee: UOP, Des Plaines, Ill.

[21] Appl. No.: 274,259

[22] Filed: Nov. 21, 1988

[51] Int. Cl.[5] ..... C10G 55/06; C10G 11/18

[52] U.S. Cl. ..... 208/85; 208/113; 208/159; 208/160; 208/164; 502/44

[58] Field of Search ..... 208/113, 164, 159, 160, 208/85; 502/44

[56] References Cited

U.S. PATENT DOCUMENTS

| | | | |
|---|---|---|---|
| 2,386,491 | 10/1945 | McOmie | 208/160 |
| 2,963,421 | 12/1960 | Luckenbach | 208/160 |
| 3,392,110 | 7/1968 | Payne | 208/164 |
| 4,162,213 | 7/1979 | Zrinscak et al. | 208/164 |
| 4,353,812 | 10/1982 | Lomas et al. | 208/164 |
| 4,424,192 | 1/1984 | Lomas et al. | 208/164 |
| 4,434,245 | 2/1984 | Lomas et al. | 502/41 |
| 4,438,071 | 3/1984 | Vickers et al. | 208/164 |
| 4,595,567 | 6/1986 | Hedrick | 165/104.16 |
| 4,724,065 | 2/1988 | Bartholic et al. | 208/159 |
| 4,757,039 | 7/1988 | Lomas | 208/113 |
| 4,786,622 | 11/1988 | Walters et al. | 208/161 |

*Primary Examiner*—Anthony McFarlane

*Attorney, Agent, or Firm*—Thomas K. McBride; John G. Tolomei

[57] ABSTRACT

A process for the fluidized catalytic cracking of an FCC feedstock uses a backmix catalyst cooler to heat FCC feed and control tube wall temperatures to avoid coking and thermal cracking. Heated FCC feed contacts the catalyst in a reactor riser to convert the feedstock. Prior heating of the feed raises its temperature so that it is more easily vaporized and better distributed throughout the riser. Using FCC catalyst to heat the feed maintains the heat balance between the reactor and the regenerator so that the catalyst circulation to the riser can remain unchanged. The backmix type cooler has heat exchange tubes located in a separate vessel. Catalyst from the dense bed of a regeneration zone is circulated to a section of the cooler located above the heat exchange tubes. One form of the invention uses two conduits to transfer catalyst to the section of the cooler above the exchange tubes and thereby control the temperature of the catalyst above the heat exchange tubes. Heat exchange and tube wall temperatures are controlled by the addition of fluidizing gas.

5 Claims, 1 Drawing Sheet

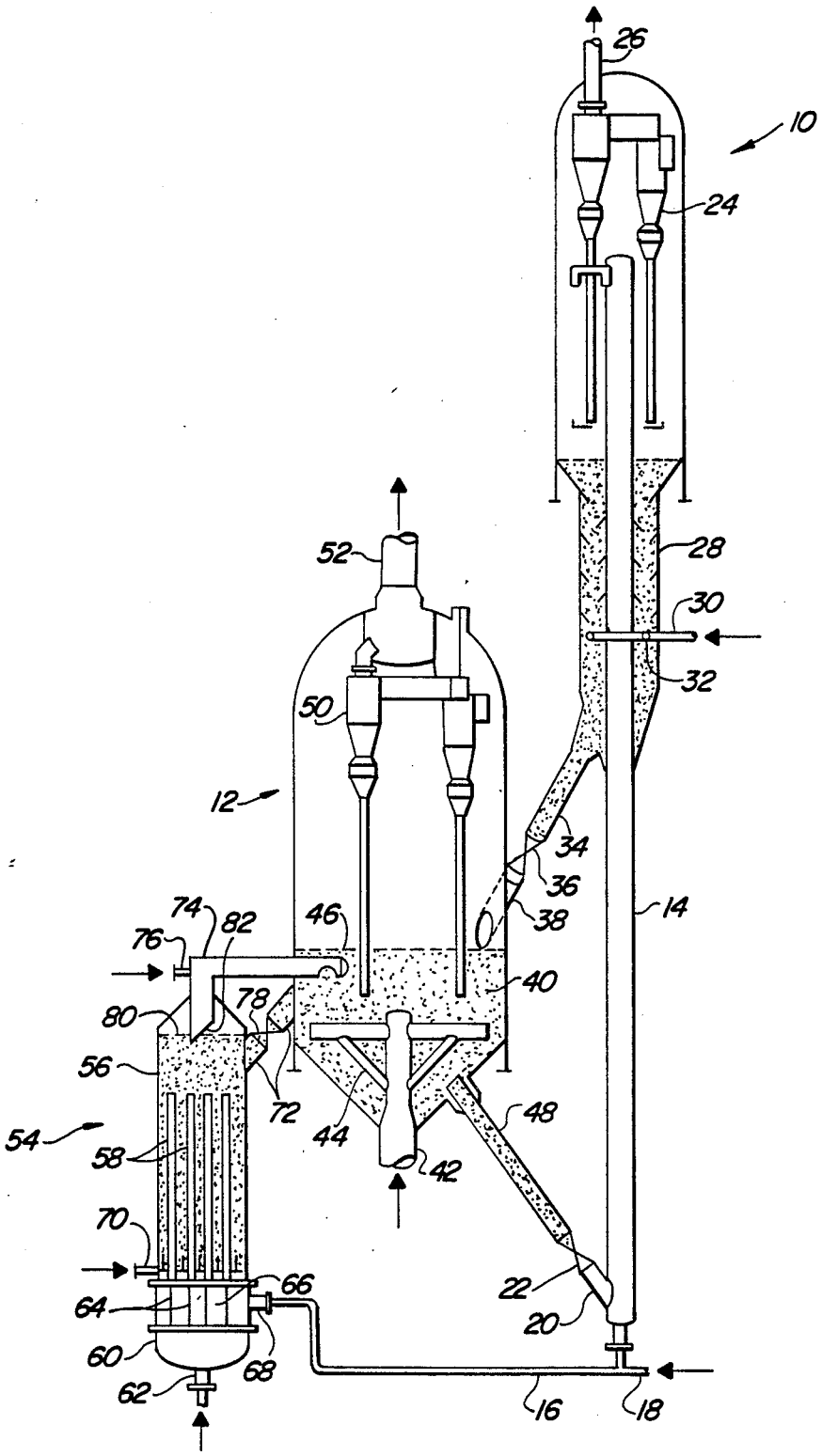
26
10
24
28
30
32
52
50
12
34
36
38
14
74
82
46
76
40
78
80
56
72
48
54
44
58
42
70
66
22
64
20
60
68
62
16
18

HEATING FCC FEED IN A BACKMIX COOLER

FIELD OF THE INVENTION

This invention relates generally to processes for the fluidized catalytic cracking of heavy hydrocarbon streams such as vacuum gas oil and reduced crudes. This invention relates more specifically to a method for heating an FCC feedstock in a backmix type catalyst cooler that cools regenerated catalyst.

BACKGROUND OF THE INVENTION

The fluidized catalytic cracking of hydrocarbons is the main stay process for the production of gasoline and light hydrocarbon products from heavy hydrocarbon charge stocks such as vacuum gas oils. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield of gasoline products.

The basic equipment or apparatus for the fluidized catalytic cracking (hereinafter FCC) of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with stream or another stripping medium. The FCC process is carried out by contacting the starting material whether it be vacuum gas oil, reduced crude, or another source of relatively high boiling hydrocarbons with a catalyst made up of a finely divided, particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio. That is, if it is desired to increase the conversion rate, an increase in the rate of flow of circulating fluid catalyst from the regenerator to the reactor is effected. Since the catalyst temperature in the regeneration zone equilibrates at a significantly higher temperature than the reaction zone temperature, increasing the catalyst flux from the relatively hot regeneration zone to the reaction zone while maintaining a constant feed preheat temperature effects an increase in the reaction zone temperature.

As the development of FCC units has advanced, temperatures within the reaction zone were gradually raised. It is now commonplace to employ temperatures of about 525° C. (975° F.). At higher temperatures, there is generally a loss of gasoline components as these materials crack to lighter components by both catalytic and strictly thermal mechanisms. At 525° C., it is typical to have 1% of the potential gasoline components thermally cracked into lighter hydrocarbon gases. As temperatures increase, to say 1025° F. (550° C.), most feedstocks can lose up to 6% or more of the gasoline components to thermal cracking.

One improvement to FCC units, that has reduced the product loss by thermal cracking, is the use of riser cracking. In riser cracking, regenerated catalyst and starting materials enter a pipe reactor and are transported upward by the expansion of the gases that occurs upon contact with the hot catalyst and is the result of vaporization of the feedstock hydrocarbons, and any fluidizing medium that may be present and reaction of the feedstock hydrocarbons. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds.

Better control of contact time and a reduction in backmixing is obtained by promoting good initial mixing and rapid vaporization of the feedstock. Atomizing feed distributors are now commonly used to improve the dispersion of feedstock into the fluidized catalyst stream. Raising the temperature of incoming feed prior to contact with the catalyst also improves the rate and extent of vaporization. Hence, a hotter feed can promote better feed distribution and contact time control.

A hotter feed can also facilitate the use of higher reaction zone temperatures. By heating the feed, reaction zone temperatures can be increased without circulating additional hot catalyst from the regeneration zone. However, externally heating the feedstock will put additional heat into the FCC system. A portion of the added heat gets transferred to the regenerator and, unless removed, will raise the temperature of the regenerated catalyst. Therefore, absent some form of additional heat removal, heating the feed will alter the heat balance between the reactor and regenerator thereby requiring a change in the catalyst to oil ratio. Accordingly, in some cases, heating the feed can decrease the catalyst to oil ratio to unacceptably low levels. As a result, it is highly desirable to have a means for removing heat from the regenerator so that the catalyst to oil ratio and heat balance can remain substantially fixed while injecting feed at a higher temperature and maintaining a constant reactor temperature.

Catalyst coolers are a well known method for removing heat from FCC regenerators. These coolers remove a portion of the heat that evolves in the regenerator from the combustion of coke so that catalyst and regenerator temperatures remain within acceptable limits. As FCC feedstocks become heavier, cooler use has become more widespread. One popular type of catalyst cooler, generally referred to as a remote cooler, has a series of indirect heat transfer tubes contained in an exchanger vessel situated outside the regenerator. Catalyst circulates between the exchanger vessel and the regenerator, while a cooling medium, usually water and saturated steam, passes through the cooling tubes. Most catalyst coolers employ dense phase conditions and are either of the flow-through or backmix type. FCC feed temperature is externally controlled before it is added to an FCC reactor; maintaining a constant regenerator temperature with increasing feed temperature requires additional catalyst cooler duty to remove the added heat input from the feed. Providing a heater to raise feed temperature and a catalyst cooler to then take the heat out is thermodynamically inefficient and adds to the cost of operating the process.

It has been suggested in U.S. Pat. No. 2,735,802, issued to Jahnig, that oil feed may be preheated in a flow-through-type catalyst cooler. Using a catalyst cooler to heat feed, advantageously shifts the heat balance in the FCC system to raise the feed temperature without generating additional heat for removal in the regenerator. It is generally known, and acknowledged in Jahnig, that preheating of an FCC feedstock can pose cracking and coking problems. Raising the temperature of the feed above 700°–800° F. promotes thermal cracking of the feed which, unlike catalytic cracking, causes the random cracking of hydrocarbon chains and the polymerization and dehydrogenation of higher molecular weight hydrocarbons. These reactions reduce liquid product yield and increase the yield of light gases and coke. Hence, surface temperatures of the tube walls must be carefully controlled in order to avoid temperatures that can result in thermal cracking. A flow-through type cooler, as shown in Jahnig, passes catalyst into the heat exchanger tubes at one point and withdraws catalyst from the heat exchange tubes at a different point. With this type of catalyst flow, the tubes at the point of catalyst entry are exposed to higher temperatures than the tubes at the point of catalyst withdrawal. Such temperatures gradients in the catalyst that contact the tubes can result in locally hotter tube temperatures, particularly in view of the relatively low heat transfer coefficient between the tubes and the oil. Therefore, while the average temperature of the oil as it leaves the cooler may not promote thermal cracking, the flow-through design can thermally crack the feed where it contacts localized hot tube sections.

It is an object of this invention to offer an improved method of heating FCC feed in a remote catalyst cooler.

Another object of this invention is to provide a remote catalyst cooler of simplified design for preheating an FCC feed.

It is another object of this invention to provide a remote catalyst cooler that specifically suits the duty requirements for heating an FCC feedstock.

It is a yet further object of this invention to provide a process for heating FCC feedstock in a remote catalyst cooler that offers improved control of the temperature of the surface of heat exchange elements.

BRIEF DESCRIPTION OF THE INVENTION

This invention is a process for reacting a heated FCC feed with a fluidized catalyst for an FCC reactor/regenerator system that avoids thermal cracking of the feed and is readily practiced in an FCC unit having a dense bed of catalyst in the regeneration zone. The process uses a backmix type cooling zone to heat the FCC feed by circulating catalyst between the cooler and a dense bed of catalyst in the regeneration zone. The heated feed then passes through an FCC reactor of a type normally used in the art and the spent catalyst from the reactor is returned to the regenerator. In simplest form, heat removal from the cooler is controlled by varying the addition of fluidization gas to a cooler and thereby altering the heat transfer coefficient between catalyst and heat transfer tubes on the tube side of the cooler.

Accordingly in one embodiment, this invention is a process for the fluidized catalytic cracking of an FCC feedstock. Looking at the reactor side, the process begins with the contacting of a heated feedstock with hot FCC catalyst in a reactor riser which at least partially converts the feedstock to lower boiling products and deposits coke on the FCC catalyst. Coke-containing spent catalyst and hydrocarbon vapors are separated in an upper reactor section so that the product containing stream is relatively free of spent catalyst particles. The spent catalyst particles are transferred to a regeneration zone where coke is combusted from the catalyst particles to produce hot FCC catalyst. Hot catalyst from the regenerator is circulated between the regeneration zone and the upper portion of a remote catalyst cooler. The cooler is of a backmix type that has a lower section closed to external catalyst circulation and contains a plurality of heat exchange tubes that are located in a lower section of the cooler. A relatively cold FCC feedstock enters the tube side of the heat exchange tubes and passes through the cooler to produce the previously mentioned heated FCC feedstock. The temperature of the surface of the tubes that are in contact with the feedstock are controlled by adjusting the amount of fluidizing gas that passes through the shell side of the cooler. The rate at which fluidizing gas passes through the cooler directly controls the heat transfer coefficient between the catalyst and tubes and indirectly affects heat transfer and cooler temperatures by controlling the interchange of catalyst between upper and lower portions of the cooler and influencing the interchange of catalyst between the regenerator and the cooler. Thus, the amount of fluidizing gas dispersed into the cooler can be varied as needed to keep the tube walls below a temperature that will promote coke formation and tube wall fouling and maintain a relatively constant catalyst temperature throughout the shell side of the cooler. Fluidizing gas is passed from the lower portion of the cooler into the upper portion of the cooler and finally into the regeneration zone. Hot FCC catalyst is then withdrawn from the regenerator and transferred to the reactor along with heated FCC feed from the catalyst cooler.

In another embodiment, this invention is a process for fluidized catalytic cracking of an FCC feedstock. The process again begins by contacting a heated FCC feedstock and hot FCC catalyst in a reactor riser to at least partially convert the FCC feedstock to lower boiling hydrocarbon products and, as a result of a contact, deposit coke on the FCC catalyst. Coke-containing spent FCC catalyst and hydrocarbons are separated in an upper reactor section. The spent FCC catalyst particles are returned to a regeneration zone that contains a dense phase section. Coke is combusted from the catalyst in the combustion section of the regenerator to produce hot FCC catalyst. A first conduit withdraws hot FCC catalyst from the combustion section and transfers it to the upper end of a backmix type catalyst cooler. The catalyst cooler has a heat exchange section located below the upper end of the cooler that contains a plurality of heat exchange tubes. A second conduit takes relatively cool regenerated catalyst from the upper end of the cooler and transfers it back to the combustion section of the regenerator. A first fluidizing gas stream is passed upwardly between the heat exchange tubes through the cooler to form a dense phase catalyst bed and circulate catalyst from the upper end through the shell side of the heat exchange section. A relatively cold FCC feedstock passes through the tube side of the heat exchange section where its temperature is raised to provide heated FCC feedstock. Heat transfer in the heat exchange section is controlled by varying the addition of fluidizing gas into the heat exchange section in the amount sufficient to produce a superficial velocity of from 0.1 to 2.5 ft/sec. In order to control the temperature of the catalyst above the heat exchange section in the cooler, a second fluidizing gas stream is passed into the upper end of the cooler and/or the second conduit to control the rate at which catalyst is transferred to the cooler and thereby adjust the average catalyst temperature in the upper section of the cooler. Hot catalyst from the regenerator and heated FCC feed from the cooler are then passed to the riser.

Additional objects, embodiments and details of this invention are disclosed in the following detailed description of the invention.

BRIEF DESCRIPTION OF THE DRAWING

The drawing is an elevation view of an FCC arrangement showing a reactor/regenerator and catalyst cooler in section.

DETAILED DESCRIPTION OF THE INVENTION

This invention is more fully explained in the context of an FCC process. The drawing of this invention shows a typical FCC process arrangement. The description of this invention in the context of the specific process arrangement shown is not meant to limit it to the details disclosed therein. The FCC arrangement shown in the drawing is of an ordinary configuration consisting of a reactor 10, a regenerator 12, and an elongate riser reaction zone 14. The arrangement circulates catalyst and contacts feed in the usual manner.

The catalysts that enter the riser can include any of the well-known catalysts that are used in the art of fluidized catalytic cracking. These compositions include amorphous-clay type catalyst which have for the most part been replaced by high activity, crystalline alumina silica or zeolite containing catalysts. Zeolite catalysts are preferred over amorphous type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, aluminum, or zirconium. These catalyst compositions may have a zeolite content of 30% or more.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Looking then at the reactor side of the drawing a heated FCC feed from a conduit 16 is mixed with an additional fluidizing medium from line 18, in this case steam, and charged to the lower end of riser 14. A combined stream of feed and fluidizing medium are contacted with catalyst that enters the riser through a lower regenerator standpipe 20 in an amount regulated by a control valve 22. Although the drawing shows contact of the feed and catalyst at the initial point of catalyst entry, feed may also be added at a more downstream riser location and the catalyst initially transported up the riser by a suitable lift gas. Prior to contact with the catalyst, the feed will ordinarily have a temperature of at least 650° F. This higher temperature promotes more rapid vaporization of the feed when it contacts the catalyst so that a more uniform distribution of feed is obtained throughout the riser. By the use of this invention, added heat for raising the temperature of the entering feed is obtained from the regenerated catalyst so that the higher feed temperature is achieved without any change in the ratio of catalyst that contacts the heated feed. As the feed and catalyst mixture travels up the riser, the feed components are cracked and the mixture achieves a constant temperature. This temperature will usually be at least 900° F. Conditions within the riser usually include a catalyst density of less than 30 lb/ft$^3$. The catalyst and reacted feed vapors are then discharged from the end of riser 14 and separated into a product vapor stream and a collection of catalyst particles covered with substantial quantities of coke and generally referred to as spent catalyst. A series of cyclones 24 remove catalyst particles from the product vapor stream to reduce particle concentrations to very low levels.

Product vapor streams are transferred to a separation zone for the removal of light gases and heavy hydrocarbons from the products. Product vapors are taken from an outlet 26 and transferred directly to a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

Catalyst separated from the product feed vapors drops to the bottom of reactor 10 into a stripping section 28 that removes adsorbed hydrocarbons from the surface of the catalyst by countercurrent contact with steam. Steam enters the stripping zone 28 through a nozzle 30 and a distribution ring 32. Spent catalyst stripped of hydrocarbon vapors leave the bottom of stripper 28 through a spent catalyst standpipe 34 at a rate regulated by a control valve 36.

Regenerator 12 removes coke deposits from the catalyst. Catalyst from control valve 36 enters regenerator 12 through a nozzle 38 which directs the catalyst into a dense catalyst bed 40 located in a lower portion of regenerator 12. For the purposes of this invention, a dense catalyst bed is defined as having a density of at least 10 lb/ft$^3$. An oxygen-containing gas, in almost all cases air, is compressed and transferred into the regenerator through a nozzle 42. Nozzle 42 communicates the air to a distributor 44 that evenly disperses the air over the entire cross-section of regenerator 12. Dispersal of the air 44 maintains the dense catalyst bed 40 and establishes an upper bed surface 46. The elevation of bed surface 46 is determined by the amount of air that enters the regenerator through grid 44, i.e., the fluidization rate, and the quantity of catalyst maintained in the regenerator 12. Hot catalyst, which for the purpose of this invention means catalyst in a temperature range of from about 1100°-1400° F., is taken from bed 40 through a regenerator standpipe 48 which supplies hot catalyst to the previously described control valve 22. Small amounts of hot catalyst are entrained in air and combustion gases rising out of bed 40 and are carried above bed surface 46. The small amounts of entrained catalyst are separated by a series of cyclones 50 and returned to catalyst bed 40. Combustion gases, now relatively free of catalyst particles, leave the cyclone 50 and are taken from the regenerator by a nozzle 52 which removes the combustion gases from the process.

Hot catalyst from bed 40 communicates with a catalyst cooler 54. Catalyst cooler 54 is referred to as a remote catalyst cooler since it uses a pressure vessel separate from the regenerator to contain all of the heat exchange elements outside of the regenerator vessel or vessels. Catalyst circulating throughout the cooler has a lower temperature relative to the catalyst in dense bed 40 and is referred to as relatively cool. For the purposes of this invention, relatively cool catalyst means catalyst having a temperature at least 50° than the temperature in the regenerator. Cooler 54 is a backmix type cooler. In this type cooler hot catalyst particles are communicated to an upper end 56 of the cooler. A series of feed exchange tubes 58 are positioned below upper end 56. Catalyst circulates about the outside of the tube while a cooling medium circulates along the inside of the tubes. The cooling medium, which for the purpose of this invention comprises oil, enters a bottom chamber 60 of the cooler through a nozzle 62. Chamber 60 distributes oil to a series of small tubes 64 which extend into the interior of heat exchange tubes 58. Oil passes out of the ends of tubes 64 and along an annular space between the outside of tube 64 and the inside of tube 58. A chamber 66 collects oil passing out of tube 58 for removal by an outlet nozzle 68. Although cooler 54 has been described as having bayonette type heat exchange tubes, other types of tubes may also be used with appropriate changes to chambers 60 and 66. A fluidizing medium, in this case usually air, enters the cooler by nozzle 70 and is distributed around tubes 58 to establish a dense catalyst bed within the cooler. The dense bed has an upper level indicated by the number 80. Fluidizing gas travels upwardly through the cooler into upper section 56 and passes into the regenerator through one or more nozzles that communicates bed 40 with upper section 56. In addition to establishing the dense bed within the catalyst cooler, the fluidizing gas also aids in the circulation of catalyst.

Heat transfer between the catalyst and the oil is governed by the following heat transfer equation.

$$Q=HA(T_2-T_1)$$

Where Q equals the total amount of heat transferred, H is the overall heat transfer coefficient across the heat exchange tubes, A equals the total surface area of the heat exchange tubes, $T_2$ is the temperature of the catalyst and $T_1$ is the temperature of the oil. This invention controls the heat transfer and the temperature of the raw oil by varying overall heat transfer coefficient H and the temperature of the catalyst $T_2$ that is in contact with the tubes.

Heat transfer is affected by the amount of fluidization gas that is added through nozzle 70. Fluidization gas is normally added at a rate that will maintain a superficial velocity of 0.1 to 2.5 ft/sec. in the open area around the heat exchange tubes 58. In order for any heat exchange to take place between the catalyst and the oil, a minimal amount of fluidization gas is necessary to keep hot catalyst in contact with the tube wall surfaces. At very low fluidization rates, it is possible to obtain a very small degree of backmixing between the upper section 56 and the lower section of the catalyst cooler thus, lowering the temperature of the catalyst $T_2$ that is in contact with the tubes. However, for tube lengths on the order of approximately 20 feet, even low fluidization rates will maintain a fairly uniform temperature in the catalyst on the outside of the heat transfer tubes. As the fluidization gas rate increases, the heat transfer coefficient, between the catalyst and the oil, across the tube wall increases causing an overall increase in the heat withdrawal from the cooler. Increasing the quantity of fluidizing gas continues to increase the heat transfer coefficient up to the point where the additional heat transfer between the tube wall and catalyst particles is offset by the decreased catalyst density between the tubes. Adding additional fluidizing gas has the simultaneous effect of increasing the interchange or backmixing of hot catalyst particles between the upper section 56 and the lower section of the catalyst cooler. Increasing the backmixing, increases the temperature $T_2$ thereby again raising the overall amount of heat withdrawn through the cooler. Therefore, changing the rate of fluidizing gas addition to the cooler has a significant impact on overall heat withdrawal from the cooler.

Changing the rate at which fluidizing gas is added to the cooler also affects the interchange of catalyst between the regenerator bed 40 and upper end 56. In simplest form, catalyst is interchanged between the catalyst bed and upper end 56 through a large opening that has sufficient cross-sectional area to allow catalyst to move back and forth between the regenerator and the cooler. When a single large conduit is used to transfer catalyst between the regenerator and the cooler, an increase in the fluidizing gas will also increase the exchange of catalyst through the conduit thus, increasing the temperature of the catalyst in the upper section 56. In a single large conduit, the majority of the fluidizing gas travels back to the regenerator along the upper surface of the conduit while catalyst entering the cooler progresses along a lower surface of the conduit.

The drawing shows an alternate method of transferring catalyst between upper zone 56 and catalyst bed 40. In this arrangement, catalyst is transferred from bed 40 to upper zone 56 by a transfer line 72. A gas conduit 74 transfer fluidizing gas and catalyst from upper end 56 back to bed 40. Upper bed level 80 interfaces with a sloped surface 82 at the inlet of conduit 74. The upper conduit can be used to directly control the catalyst circulation to the upper end 56. As the fluidizing gas entering nozzle 70 leaves the cooler through conduit 74, the smaller cross-section of the conduit relative to the cooler creates a lower catalyst density therein. Thus, this gas flow creates a constant circulation of catalyst. By adding additional fluidizing gas into conduit 74 through a nozzle 76, the density in conduit 74 and the rate of catalyst transfer through conduit 74 can be further increased. Therefore, by varying the rate of fluidizing gas added in nozzle 76, catalyst circulation through upper end 56 can be maintained at the desired rate to provide control of the catalyst temperature in upper end 56 independent of the rate of fluidizing gas addition through nozzle 70. With the two conduit system, the catalyst will usually circulate through the upper end 56 at a rate of 100 to 200 $lb/ft^2/sec$. As a result, the use of two conduits to exchange catalyst to the upper end 56 in the manner described allows the temperature above the heat exchange tubes 58 to be controlled by the addition of fluidizing gas through nozzle 76 and the heat exchange and temperature of catalyst on the outside of tubes 58 to be controlled by the addition of fluidizing gas through nozzle 70. The ability to independently control heat transfer in the tube section and the temperature of catalyst above the tubes provides the necessary control for avoiding tube wall temperatures that could lead to thermal cracking. Further control of the catalyst circulation rate through upper end 56 can be obtained by the use of a control valve 78 across conduit 72.

The conditions under which oil is transferred through the tubes is of considerable importance in this invention. In most catalyst cooler arrangements where the cooling medium is water or saturated steam, the surface of the tubes separating the cooling medium and catalyst will approximate the temperature of the cooling medium due to the high heat transfer rate associated with the steam or water and the phase change between steam and water. In the case of oil as a cooling medium, the heat transfer rate is considerably lower and the metal temperature will normally be about 150° higher than the average temperature of the circulating oil. In order to avoid localized thermal cracking and/or coking along the hot tube oil surfaces, the oil passes through the tubes at a high velocity. Oil passes through the tubes at a velocity of at least 7 ft/sec. with velocities of 10 ft/sec. or more being preferred.

It is believed that the process of this invention will function most effectively when the oil passes through the tubes in all liquid phase. Although some vaporization of lower boiling feed components may occur, substantial vaporization should be avoided. If substantial vaporization were allowed to occur, the higher molecular weight feed components would accumulate along the surfaces of the tube walls. It is these feed components that are most prone to promote coke formation. Therefore, any prolonged contact of these higher molecular weight feed components with the tube wall surfaces can rapidly cause coke formation. Once coke begins to accumulate, its fouling action can accelerate the deposition of additional coke deposits.

The avoidance of vaporization and thermal cracking limits the effluent temperature of the feed to about 800° F. Lower oil effluent temperatures of about 650°–700° are preferred especially for more thermally sensitive feedstocks. FCC feeds are usually transferred from storage or upstream processing facilities at temperatures of about 300°–400° F. The maximum exchange or duty can, therefore, be obtained by passing the minimum temperature feed through the heat exchange tubes. In such cases, the feed will usually be heated to at least 500° F. However, in most cases, FCC feed is exchanged against the bottom stream of the previously mentioned main column in order to raise the feed temperature to about 520° F. and obtain a corresponding reduction in the temperature of the main column bottoms material. Where the feed is still exchanged against the main column bottoms, feed will normally enter the cooler through nozzle 62 at a temperature of 500°–550° F.

This invention has several advantages over FCC coolers that generate steam. The circulation of oil puts the heat recovery to direct use in the process instead of generating saturated steam which may be of less value to a refiner. Heating of the feed, in this invention, is also beneficial since it allows the use of a hotter feed without affecting the heat balance between the reactor and the regenerator or changing catalyst circulation rates. Using a hotter feed has direct benefits on operations within the riser.

What is claimed is:

1. A process for the fluidized catalytic cracking (FCC) of an FCC feedstock said process comprising:

(a) contacting a heated FCC feedstock and hot FCC catalyst in a reactor riser to at least partially convert said heated FCC feedstock to a product stream comprising lower boiling hydrocarbons and produce a spent FCC catalyst containing coke deposits thereon;

(b) separating said product stream from said spent FCC catalyst, recovering said product stream and transferring said spent catalyst particles to a regeneration zone;

(c) combusting coke from said spent catalyst particles in said regeneration zone and producing hot FCC catalyst;

(d) circulating catalyst particles between said regeneration zone and an upper portion of a remote catalyst cooler, said cooler having a lower section closed to external catalyst circulation and a plurality of heat exchange tubes located in said lower section;

(e) passing a heatable FCC feedstock through the tube side of said cooler in liquid phase at a velocity of at least 7 ft/sec to raise the temperature of said heatable FCC feedstock to a temperature of from 500°-700° F. and produce said heated FCC feedstock;

(f) controlling the temperature of the surfaces of said tubes in contact with said feedstock by passing fluidizing gas through the shell side of said cooler at a superficial velocity of from 0.1 to 2.5 ft/sec. forming a dense phase catalyst bed in said cooler and circulating catalyst from said upper portion around said tubes;

(g) passing fluidizing gas from said upper portion of said cooler to said regeneration zone;

(h) transferring hot FCC catalyst from said regeneration zone to said riser; and (i) passing said heated FCC feedstock from said cooler to said riser.

2. The process of claim 1 wherein catalyst is circulated between said regeneration zone and said upper portion of said cooler by a first conduit that carries a net flow of catalyst into said cooler and a second conduit that produces a net flow of catalyst out of said cooler.

3. The process of claim 1 wherein the average temperature of catalyst particles in said cooler ranges from 900°-1300° F.

4. The process of claim 2 wherein catalyst is educted through said second conduit at a flux rate of from 100 to 200 $lb/ft^2/sec$.

5. The process of claim 1 wherein said feedstock enters said cooler at a temperature of at least 500° F., passes through said heat exchange tubes at a velocity of at least 10 ft/sec. and is heated to at least 650° F.

* * * * *